US008550011B2

(12) United States Patent
Lee

(10) Patent No.: US 8,550,011 B2
(45) Date of Patent: Oct. 8, 2013

(54) ADJUSTABLE TABLE

(76) Inventor: Shyi-Yueh Lee, Kaohsiung (TW)

( * ) Notice: Subject to any disclaimer, the term of this patent is extended or adjusted under 35 U.S.C. 154(b) by 153 days.

(21) Appl. No.: 13/221,967

(22) Filed: Aug. 31, 2011

(65) Prior Publication Data

US 2013/0047898 A1 Feb. 28, 2013

(51) Int. Cl.
*A47B 1/00* (2006.01)

(52) U.S. Cl.
USPC ..... 108/86; 108/87

(58) Field of Classification Search
USPC ..... 108/83, 85–87, 89
See application file for complete search history.

(56) References Cited

U.S. PATENT DOCUMENTS

| | | | | | |
|---|---|---|---|---|---|
| 1,302,420 | A * | 4/1919 | Nyholm | 108/67 |
| 1,411,114 | A * | 3/1922 | Lundquist | 108/67 |
| 1,807,881 | A * | 6/1931 | Siskin | 108/67 |
| 2,205,274 | A * | 6/1940 | Rastetter | 108/67 |
| 2,750,242 | A * | 6/1956 | Viehmann | 108/83 |
| 2,815,257 | A * | 12/1957 | Gariepy | 108/83 |
| 2,825,613 | A * | 3/1958 | Gariepy | 108/83 |
| 3,336,883 | A * | 8/1967 | Wengi | 108/86 |
| 4,794,869 | A * | 1/1989 | Chiu | 108/86 |
| 5,806,437 | A | 9/1998 | Huang | |
| 6,729,243 | B2 * | 5/2004 | Annas | 108/86 |

FOREIGN PATENT DOCUMENTS

DE 2402922 * 7/1975

* cited by examiner

*Primary Examiner* — Janet M Wilkens
(74) *Attorney, Agent, or Firm* — Alan Kamrath; Kamrath IP Lawfirm, P.A.

(57) ABSTRACT

An adjustable table has a base, a telescopic tube assembly, two outside tabletop components and two inside tabletop components. The base has at least one leg and a mounting bracket. The telescopic tube assembly has a shaft, a central tube and two sliding tubes. The shaft is located over the mounting bracket. The central tube is mounted securely around the shaft. The sliding tubes are mounted slidably around the shaft. The outside tabletop components are mounted slidably on the mounting bracket and are slidably mounted respectively on the sliding tubes. The inside tabletop components are foldable and each has a first board mounted pivotally and slidably on one sliding tube and a second board connected pivotally to the first board. Each inside tabletop component independently folds and flips underneath the outside tabletop components abut each other or abut one of the inside tabletop components to shorten a total tabletop length.

6 Claims, 14 Drawing Sheets

ADJUSTABLE TABLE

BACKGROUND OF THE INVENTION

1. Field of the Invention

The present invention relates to a table, and more particularly to an adjustable table that has multi-step length adjustment for different purposes.

2. Description of Related Art

U.S. Pat. No. 5,806,437 discloses a table that has two legs, a base, two outer tabletop segments and two folding tabletop segments. The base is mounted on the legs and has a shaft. The outer tabletop segments are mounted on the base and are capable of sliding oppositely and synchronously through structures of engaged racks and gears. The folding tabletop segments are mounted pivotally on the shaft of the base between the outer tabletop segments and each folding tabletop segment is capable of folding, flipping and sinking under a normal tabletop level so that the outer tabletop segments move toward each other and close up into a short tabletop length. However, the folding tabletop segments cannot slide and overlap freely so that shortening the total tabletop length requires both the table top segments to be folded and flipped underneath the table. Therefore, the table merely has a single shortened configuration, which is not well adapted for different purposes.

To overcome the shortcomings, the present invention provides an adjustable table to mitigate or obviate the aforementioned problems.

SUMMARY OF THE INVENTION

The main objective of the invention is to provide an adjustable table that has multi-step length adjustments for different purposes.

An adjustable table in accordance with the present invention comprises a base, a telescopic tube assembly, two outside tabletop components and two inside tabletop components. The base has at least one leg and a mounting bracket. The telescopic tube assembly has a shaft, a central tube, and two sliding tubes. The shaft is located over the mounting bracket. The central tube is mounted securely around the shaft. The sliding tubes are mounted slidably around the shaft. The outside tabletop components are mounted slidably on the mounting bracket and are slidably mounted respectively on the sliding tubes. The inside tabletop components are foldable, and each has a first board mounted pivotally and slidably on one sliding tube and a second board connected pivotally to the first board. Each inside tabletop component independently flips underneath the tabletop, and the outside tabletop components abut each other or abut one of the inside tabletop components to shorten the total tabletop length.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
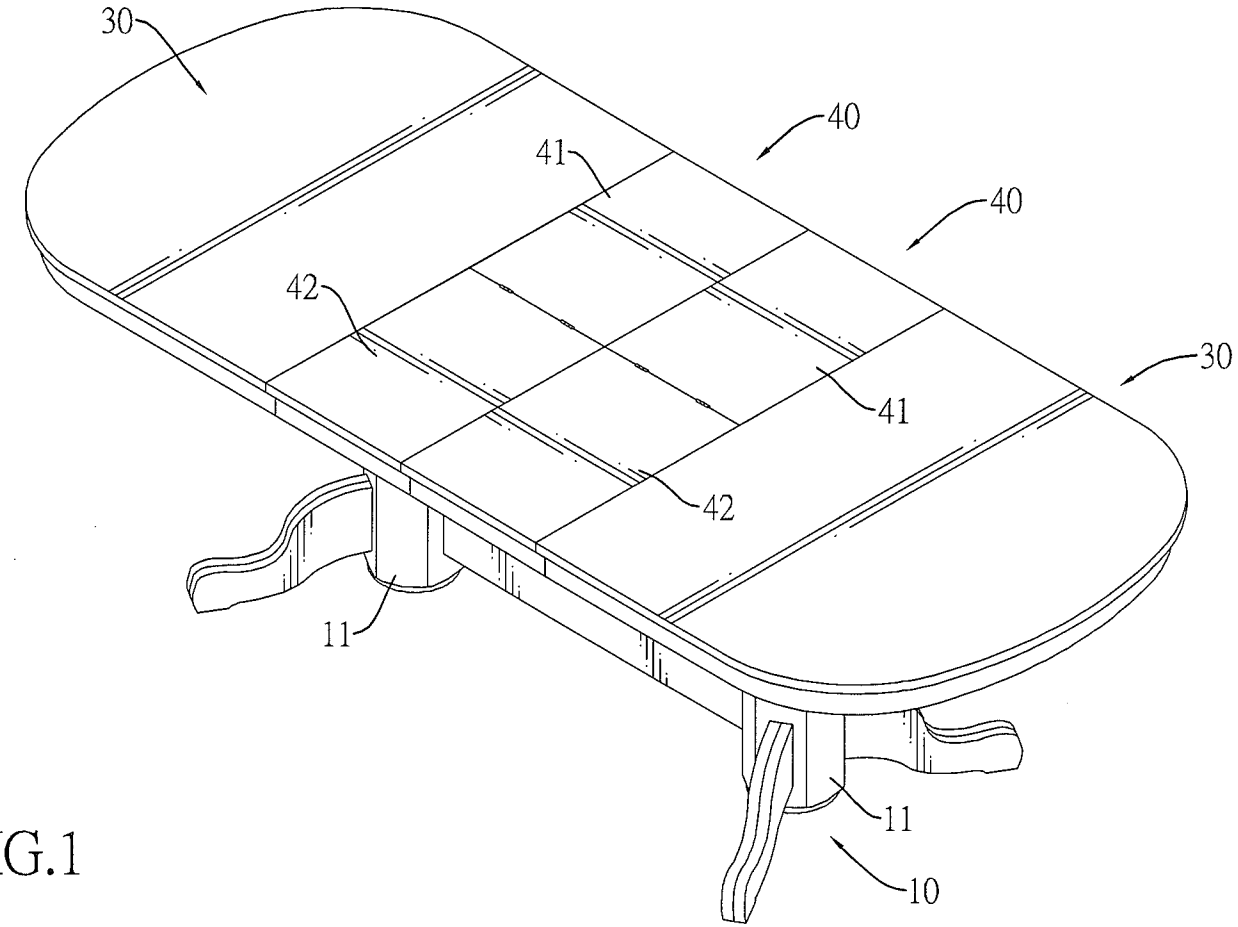
FIG. 1 is a perspective view of an adjustable table in accordance with the present invention.
Figure 2:
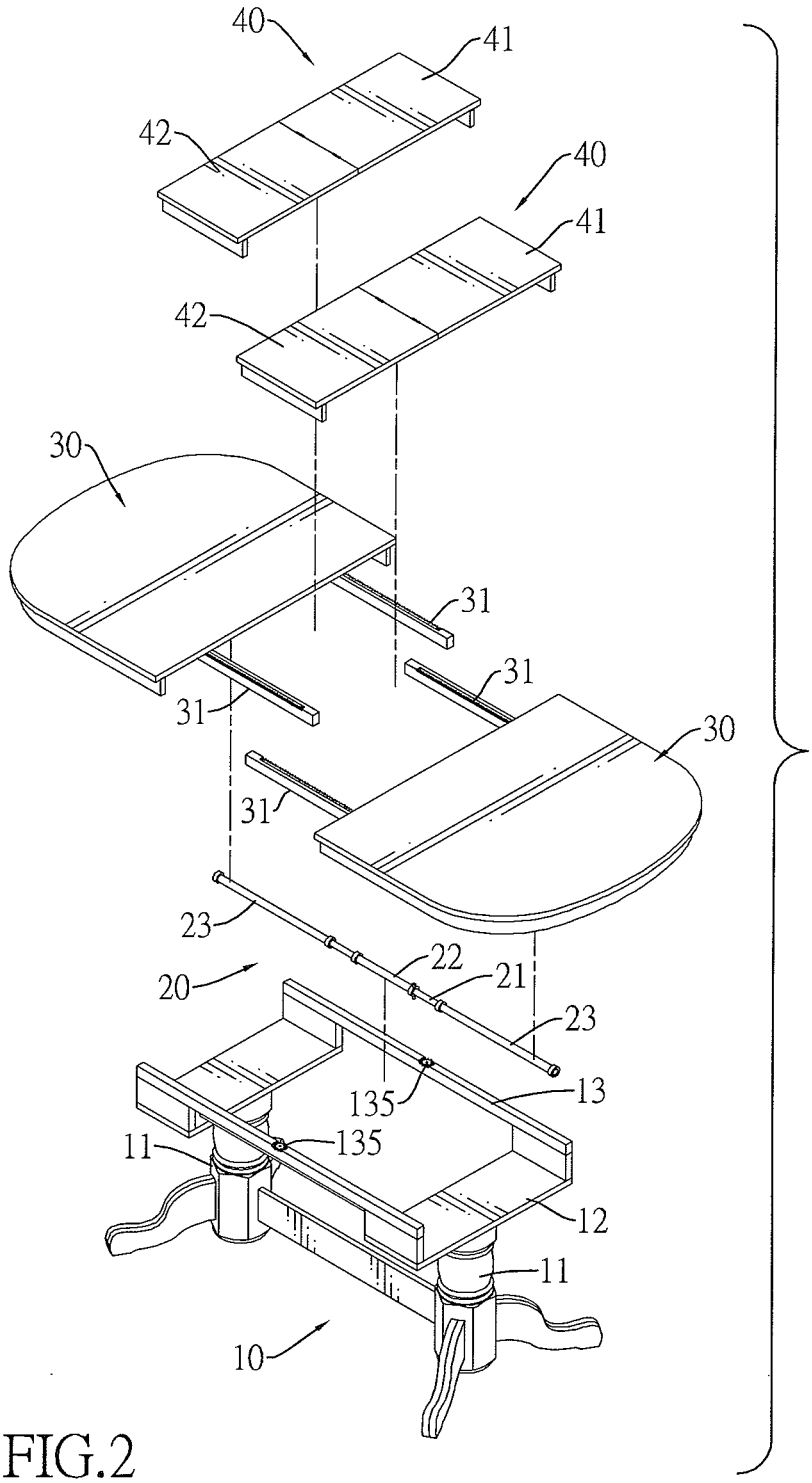
FIG. 2 is an exploded perspective view of the adjustable table in FIG. 1.
Figure 3:
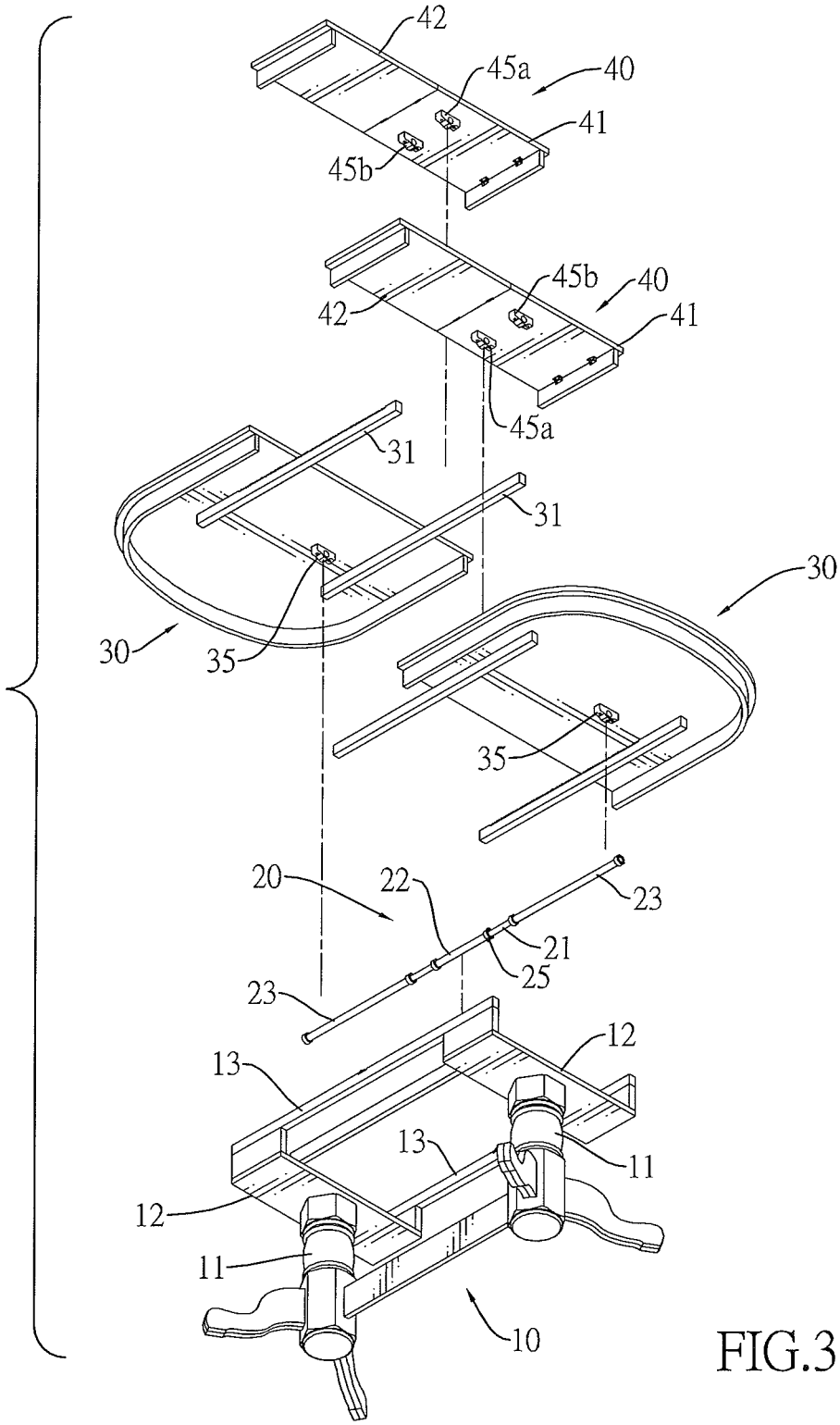
FIG. 3 is another exploded perspective view of the adjustable table in FIG. 1.
Figure 4:
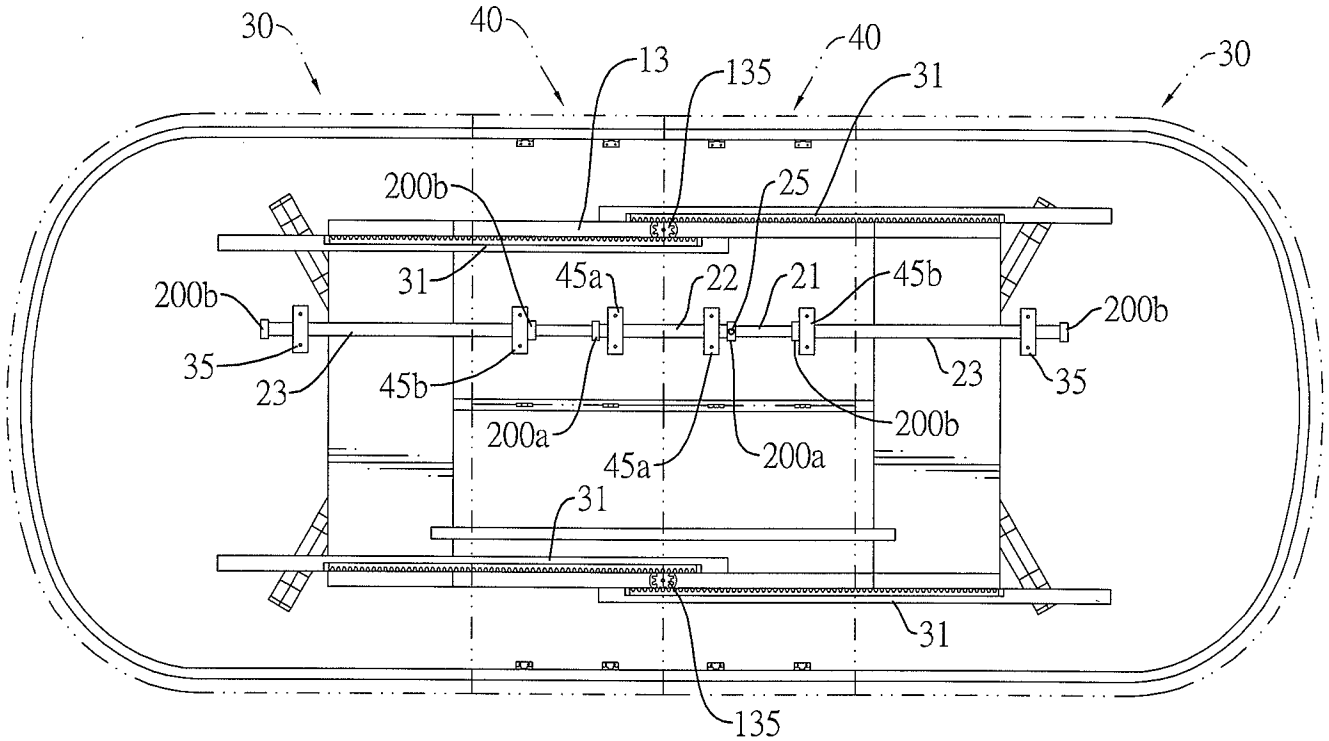
FIG. 4 is a top view of the adjustable table in FIG. 1.
Figure 5:
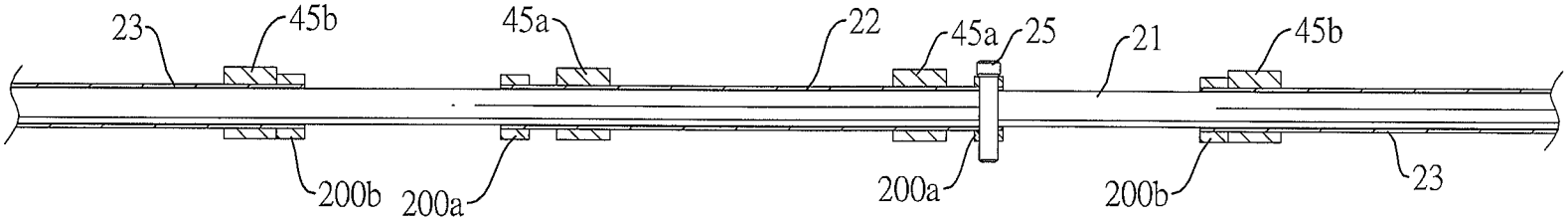
FIG. 5 is a cross sectional front view of a telescopic tube assembly of the adjustable table in FIG. 1.
Figure 6:
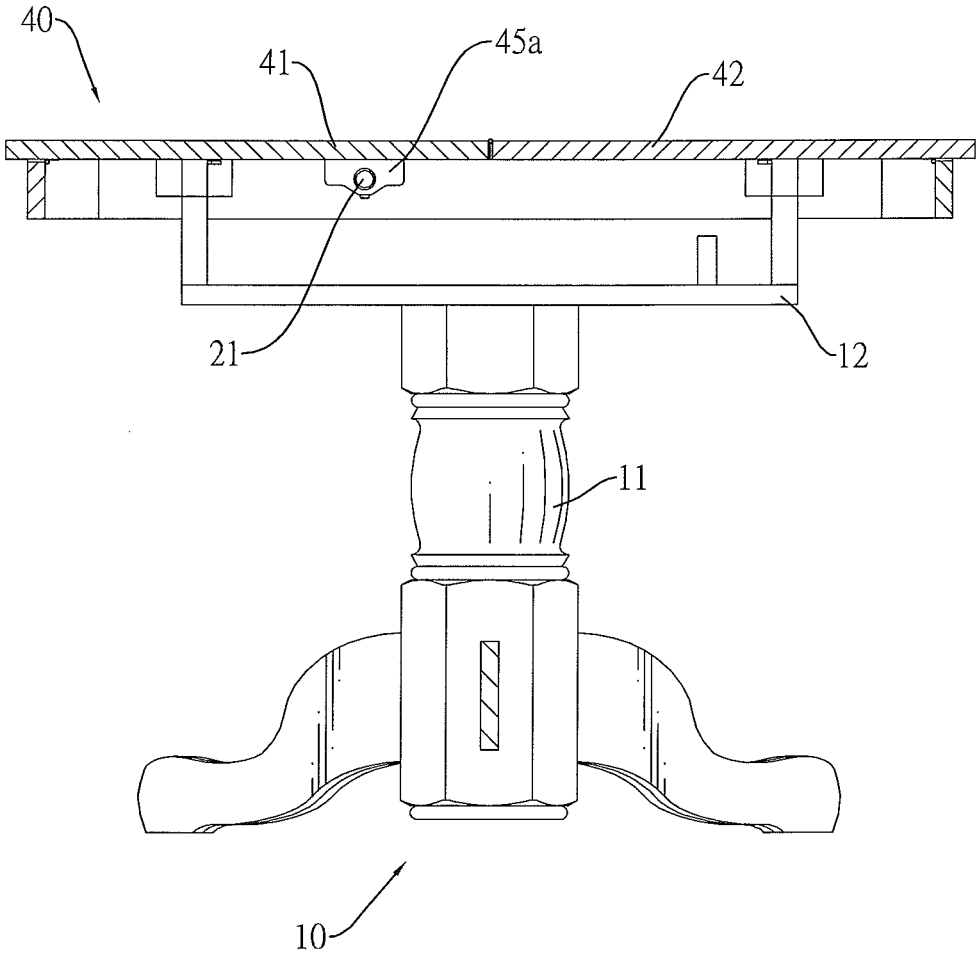
FIG. 6 is a cross sectional side view of the adjustable tube in FIG. 1.

With reference to FIGS. 1 to 6, an adjustable table in accordance with the present invention comprises a base 10, a telescopic tube assembly 20, two outside tabletop components 30 and two inside tabletop components 40.

The base 10 has at least one leg 11 and a mounting bracket 12.

Each of the leg 11 has a top end.

The mounting bracket 12 is mounted on the top end of each of the leg 11 and may have two bridges 13 as well as two first sliding elements 135. The bridges 13 are mounted oppositely on the mounting bracket 12. The first sliding elements 135 are mounted respectively on the bridges 13 and may be two gears rotatably mounted respectively on the bridges 13.

The telescopic assembly 20 is located over the mounting bracket 12 of the base 10, is indirectly connected to the mounting bracket 12 and has a shaft 21, a central tube 22, and two sliding tubes 23.

The shaft 21 is located over the mounting bracket 12.

The central tube 22 is mounted securely around the shaft 21 and may have two ends, two link flanges 200*a* and a fastening pin 25. The link flanges 200*a* are formed respectively on and protrude radially from the ends of the central tube 22. The fastening pin 25 is mounted through the central tube 22 and the shaft 21 to securely hold the central tube 22 around the shaft 21 and prevent relative sliding in between.

The sliding tubes 23 are mounted slidably around the shaft 21 with the central tube 22 located between the sliding tubes 23. Each sliding tube 23 may have two ends and two link flanges 200*b* formed respectively on and protruding radially from the ends of the sliding tube 23.

The outside tabletop components 30 are mounted slidably on the mounting bracket 12 of the base 10 and correspond to and are slidably mounted respectively on the sliding tubes 23. Each outside tabletop component 30 may have a top surface, a bottom surface, an outside sleeve 35 and two second sliding elements 31.

The outside sleeve 35 is mounted securely on the bottom surface, is mounted slidably around a corresponding sliding tube 23 and selectively abuts one of the link flanges 200*b* of the corresponding sliding tube 23. Therefore, moving the outer sleeve 35 pushes the link flange 200*b* to control the slide of the sliding tubes 23 on the shaft 21.

The second sliding elements 31 are mounted on the bottom surface and are slidably engaged respectively with the first sliding elements 135 of the base 10 so that the outside tabletop components 30 are capable of sliding on the base 10. The second sliding elements 31 may be racks engaged respectively with the gears of the base 10 so that the outside tabletop components 30 are capable of sliding symmetrically on the base 10.

The inside tabletop components 40 are foldable and correspond to the sliding tubes 23. Each inside tabletop component 40 has a first board 41 and a second board 42.

The first board 41 is mounted pivotally and slidably on the central tube 22, is mounted pivotally and slidably on a corresponding sliding tube 23 and may have a bottom and two inside sleeves 45*a*, 45*b*. The inside sleeves 45*a*, 45*b* are mounted securely on the bottom. One inside sleeve 45*a* is mounted pivotally and slidably around the central tube 22 and selectively abuts one of the link flanges 200*a* of the central tube 22. The other inside sleeve 45*b* is mounted pivotally and slidably around the corresponding sliding tube 23 and selectively abuts one of the link flanges 200*b* of the corresponding sliding tube 23. Therefore, moving the inside sleeves 45*a*, 45*b* drives the sliding tube 23 to slide. on the shaft 21.

The second board 42 is connected pivotally to the first board 41 and selectively pivots and stacks on the first board 41 so that the inside tabletop component 40 is capable of folding inward and flipping underneath the outside tabletop components 30.

Therefore, when a total tabletop length of the adjustable table is shortened, each inside tabletop component 40 independently folds and flips underneath, and the outside tabletop components 30 slide symmetrically to abut each other or abut an un-flipped inside tabletop component 40.

Figure 7:
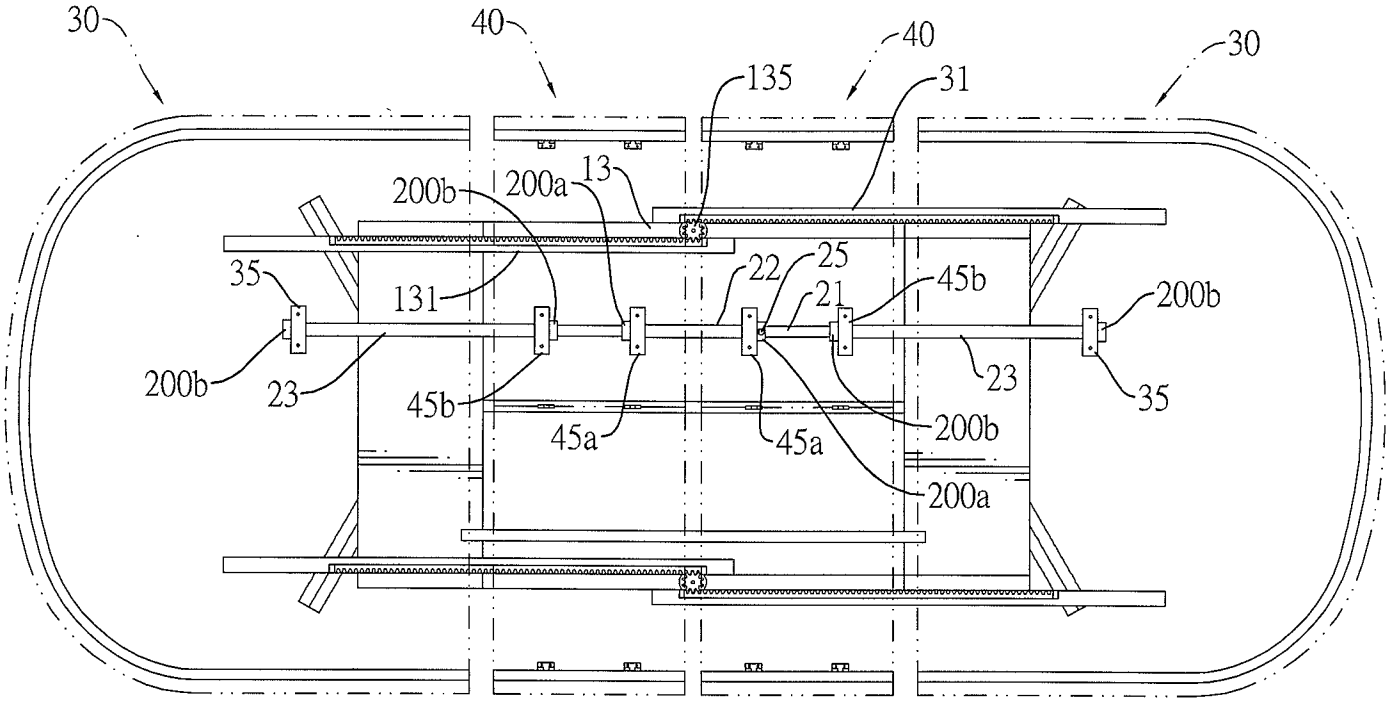
FIG. 7 is an operational top view of the adjustable table in FIG. 1 proceeding with a first step shortening operation.

With further reference to FIG. 7, to shorten the total tabletop length of the adjustable table, the outside tabletop components 30 and inside tabletop components 40 are slid outward so a space is created between any adjacent two of the outside tabletop components 30 and inside tabletop components 40. Usually, mortises and corresponding tenon are formed on edges of the inside tabletop components 40 and outside tabletop components 30 so that the intervals disengage the mortises from the tenon to allow a later operation such as pivoting the inside tabletop components 40. When pulling the outside tabletop components 30 outward, each outside sleeve 35 abuts the corresponding link flange 200*b* of the corresponding sliding tube 23 and drives the sliding tube 23 to move outward. The other link flange 200*b* abuts one inside sleeve 45*b* of the corresponding inside tabletop component 40 to drive the corresponding inside tabletop component to slide outward. Therefore, the outside tabletop components 30, sliding tubes 23 and inside tabletop components 40 are pulled outward sequentially.

Figure 8:
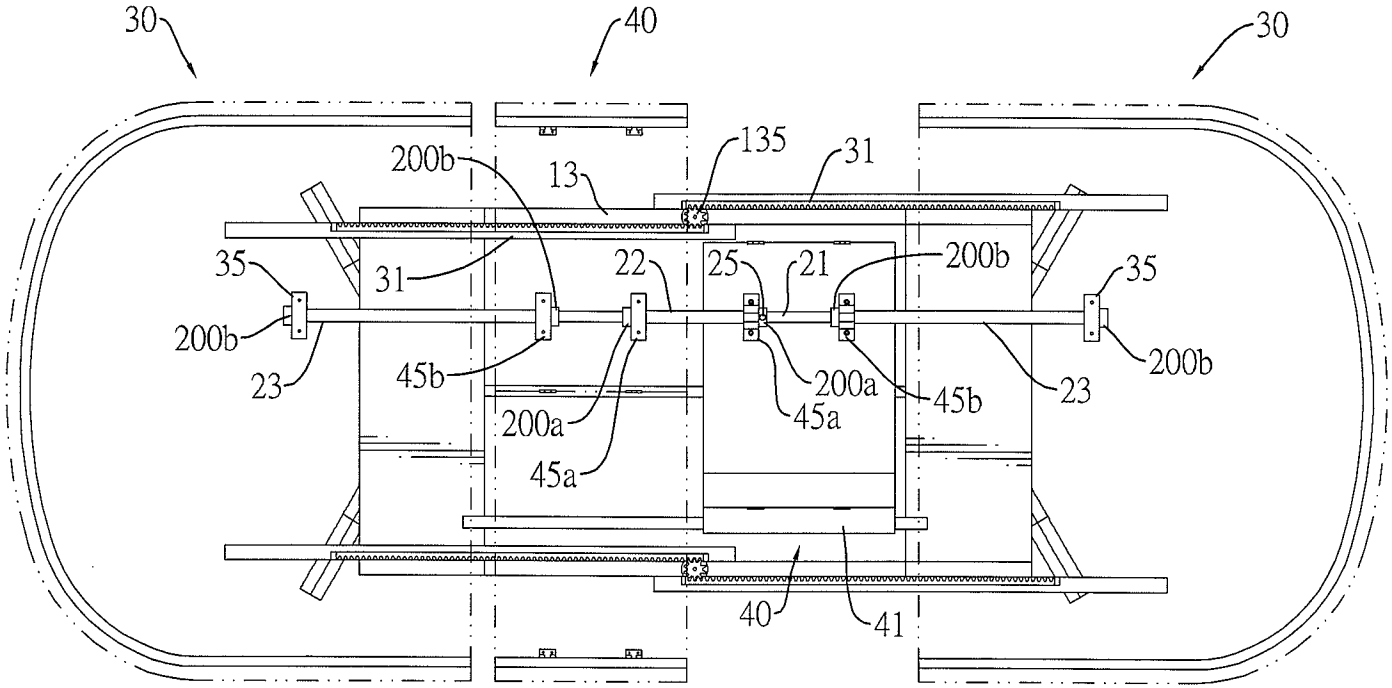
FIG. 8 is an operational top view of the adjustable table in FIG. 7.
Figure 9:
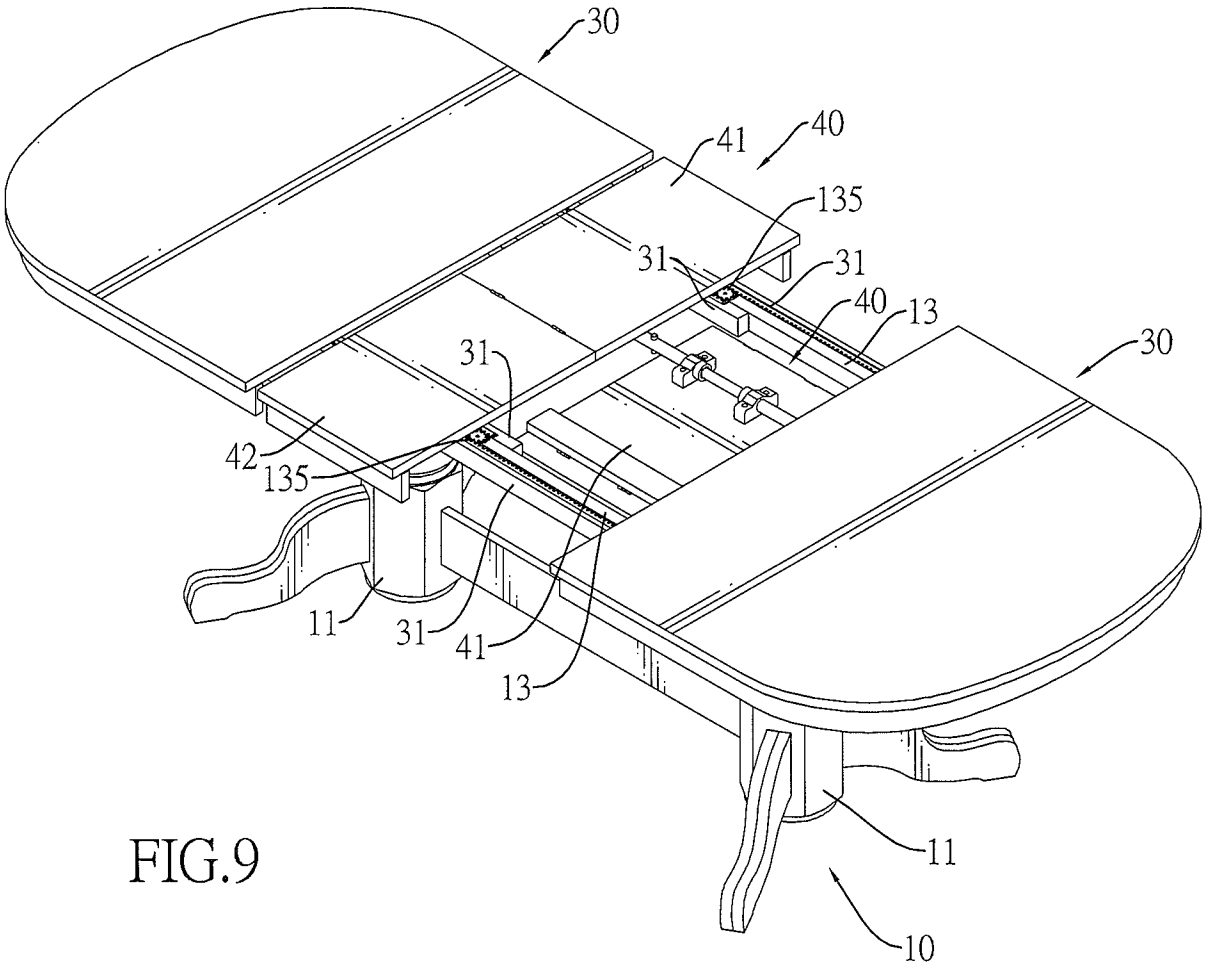
FIG. 9 is an operational top view of the adjustable table in FIG. 8.
Figure 10:
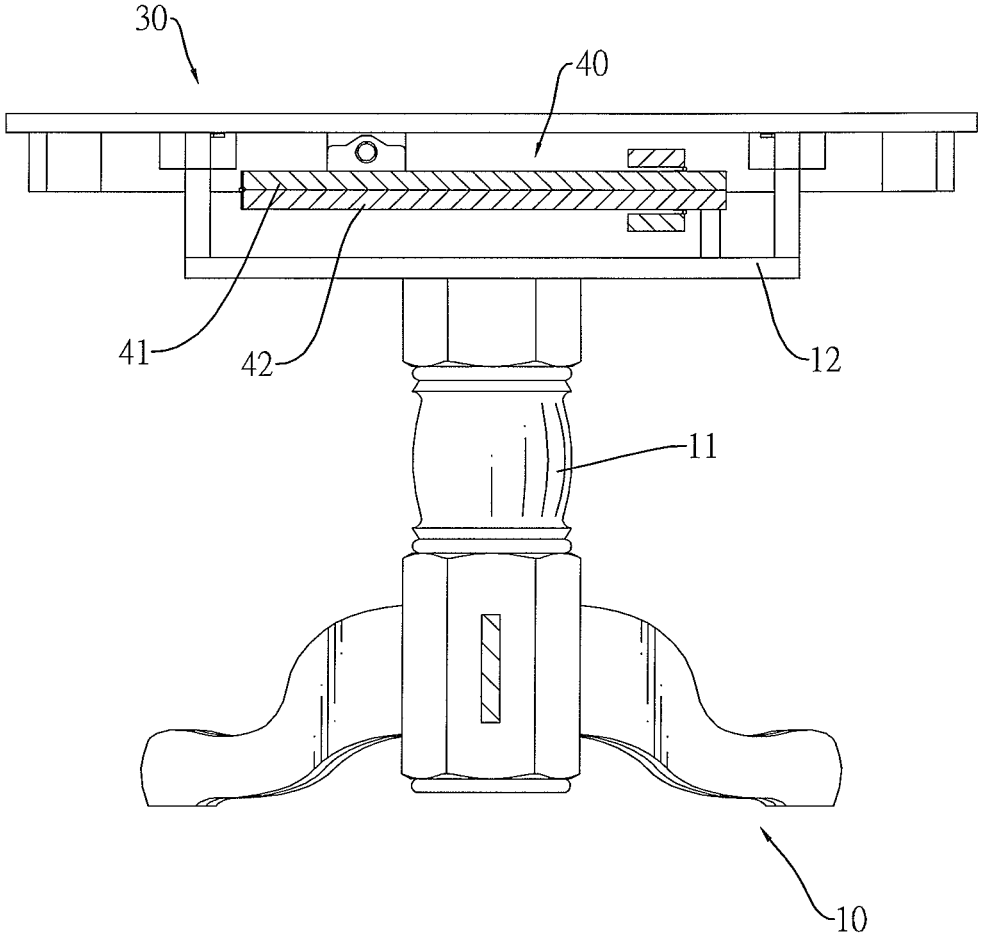
FIG. 10 is an operational cross sectional side view of the adjustable table in FIG. 8.

With further reference to FIGS. 8 to 10, one of the inside tabletop components is folded and flipped underneath the outside tabletop components 30.

Figure 11:
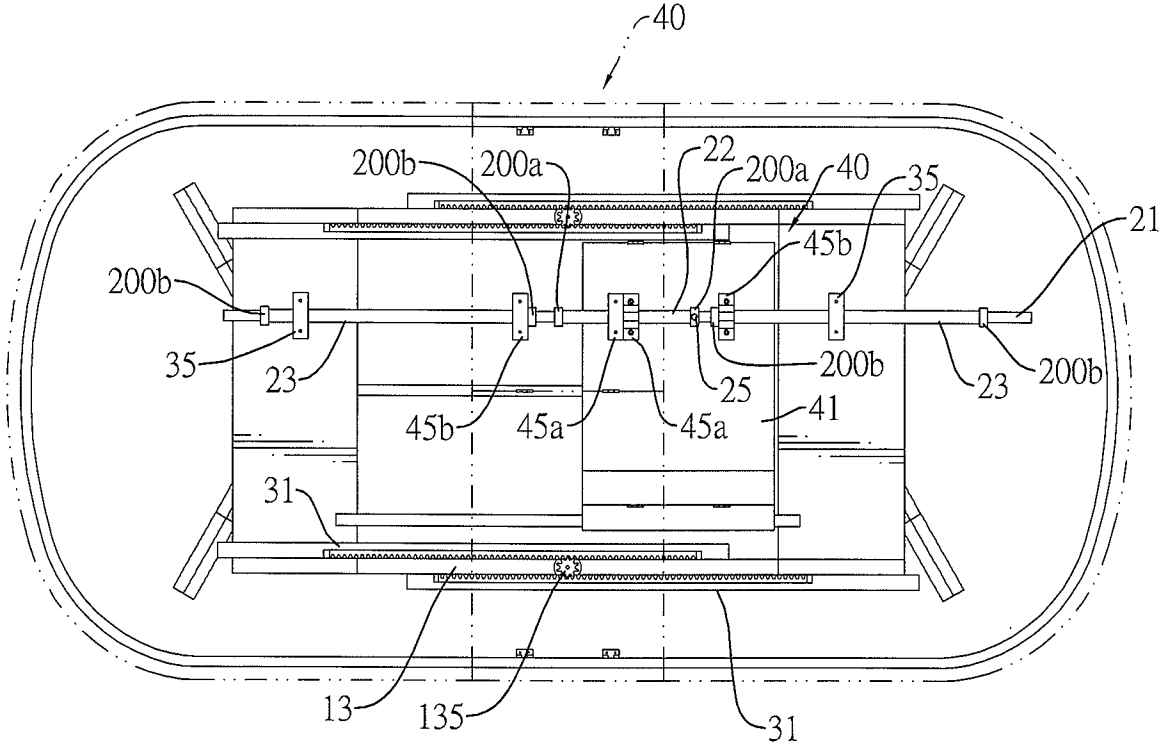
FIG. 11 is an operational top view of the adjustable table in FIG. 8.
Figure 12:
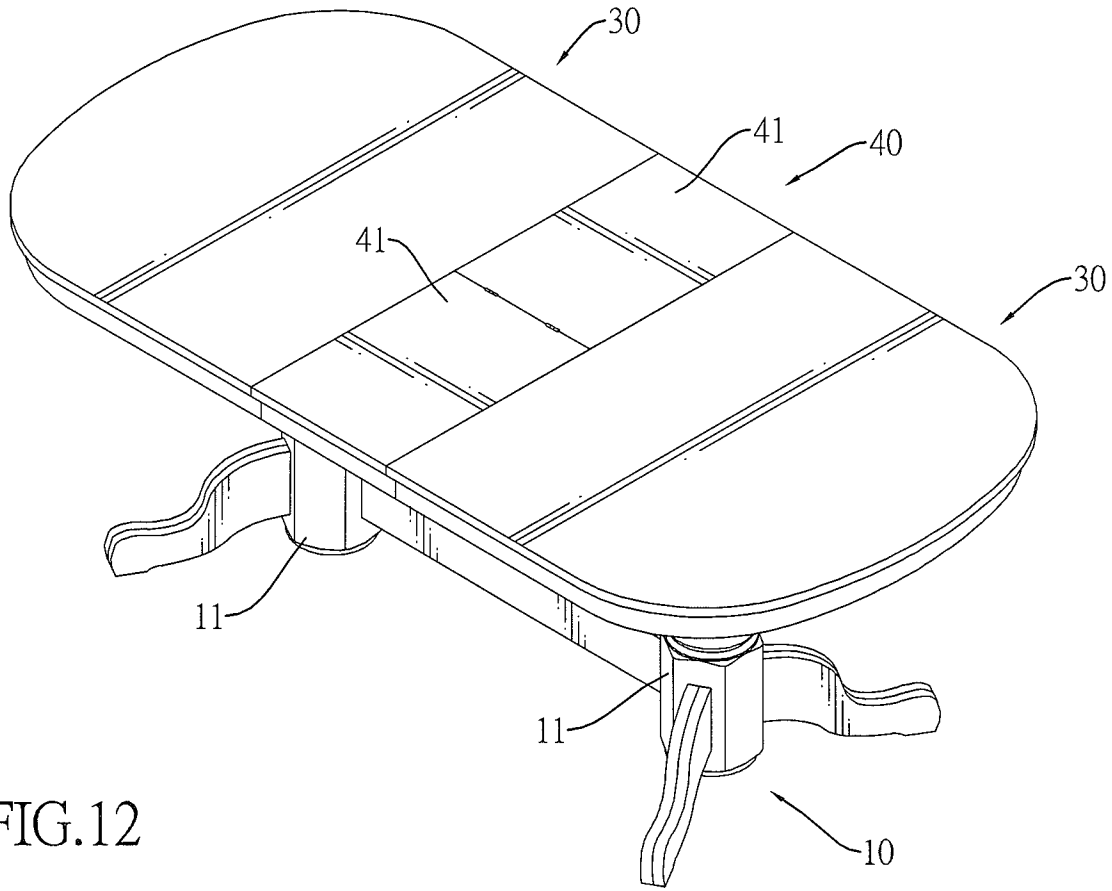
FIG. 12 is an operational perspective view of the adjustable table in FIG. 11.

With further reference to FIGS. 11 to 12, the inside tabletop components 40 are slid toward each other to overlap. The outside tabletop components 30 are slid inward so that the un-folded and un-flipped inside tabletop component 40 tightly abuts the outside tabletop components 30 in order to complete the single-step tabletop-shortening operation. During the operation, the inner inside sleeves 45*a* of the inward moving inside tabletop components 40 abut each other.

Figure 13:
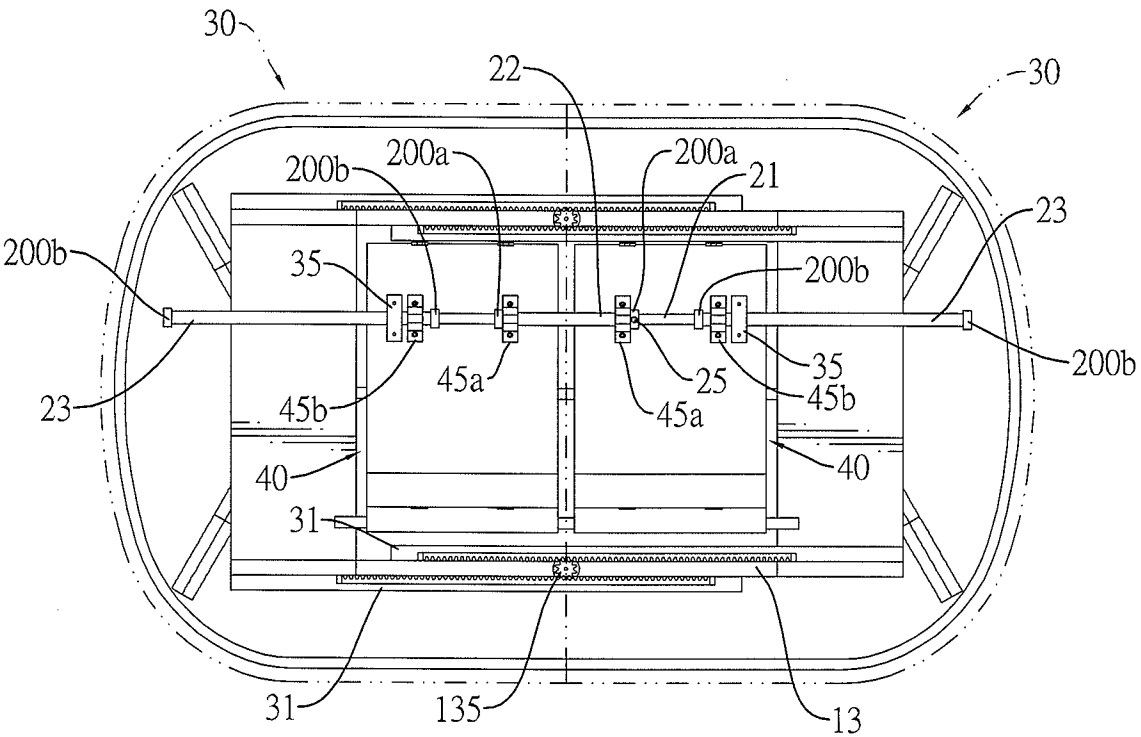
FIG. 13 is an operational top view of the adjustable table in FIG. 8 proceeding with a second step shortening operation.
Figure 14:
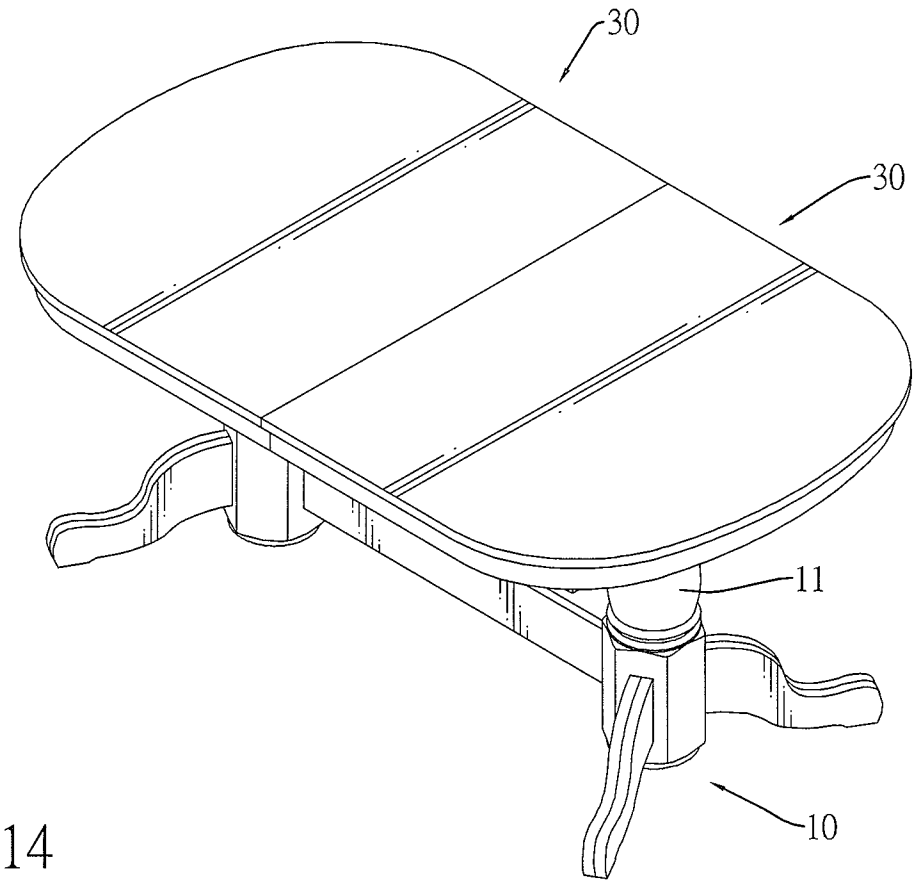
FIG. 14 is an operational perspective view of the adjustable table in FIG. 13.

With further reference to FIGS. 13 to 14, when the total tabletop length is further shortened, both the inside tabletop components 40 are folded and flipped underneath. The outside tabletop components 30 move toward and abut each other to complete the two-step shortening operation.

With the telescopic tube assembly 20, folding and flipping one inside tabletop component 40 and moving the outside tabletop components 30 to abut the other inside tabletop component 40 achieve the one-step process of the total tabletop length shortening. Folding and flipping both the inside tabletop components 40 and moving the outside tabletop components 30 to abut each other achieve the two-step process of the total tabletop length shortening. Therefore, the total tabletop length can be shortened according to different applications.

Even though numerous characteristics and advantages of the present invention have been set forth in the foregoing description, together with details of the structure and function of the invention, the disclosure is illustrative only. Changes may be made in the detail, especially in matters of shape, size, and arrangement of parts within the principles of the invention to the full extent indicated by the general meaning of the terms in which the appended claims are expressed.

What is claimed is:

1. An adjustable table comprising:

a base having at least one leg and each of the at least one leg having a top end; and a mounting bracket mounted on the top end of each of the at least one leg;

a telescopic tube assembly located over the mounting bracket of the base, indirectly connected to the mounting bracket and having a shaft located over the mounting bracket;

a central tube mounted securely around the shaft; and two sliding tubes mounted slidably around the shaft with the central tube located between the sliding tubes;

two outside tabletop components mounted slidably on the mounting bracket of the base, corresponding to and slidably mounted respectively on the sliding tubes and each outside tabletop component having a top surface and a bottom surface; and two inside tabletop components being foldable and corresponding to the sliding tubes and each inside tabletop component having a first board mounted pivotally and slidably on the central tube and mounted pivotally and slidably on a corresponding sliding tube; and a second board connected pivotally to the first board and selectively pivoting and stacking on the first board;

wherein each inside tabletop component is capable of independently folding and flipping underneath the outside tabletop components, and the outside tabletop components slide to abut each other or abut an un-flipped inside tabletop component so that a total tabletop length of the adjustable table is shortened.

2. The adjustable table as claimed in claim 1, wherein each outside tabletop component further has an outside sleeve mounted securely on the bottom surface and mounted slidably around a corresponding sliding tube; and the first board of each inside tabletop component has a bottom and two inside sleeves mounted securely on the bottom, one inside sleeve is mounted pivotally and slidably around the central tube and the other inside sleeve is mounted pivotally and slidably around the corresponding sliding tube.

3. The adjustable table as claimed in claim 2, wherein the central tube has two ends and two link flanges formed respectively on and protruding radially from the ends of the central tube;

each sliding tube has two ends and two link flanges formed respectively on and protruding radially from the ends of the sliding tube;

the outside sleeve of each outside tabletop component selectively abuts one of the link flanges of the corresponding sliding tube; and the inside sleeve of each inside tabletop component mounted around the central hole selectively abuts one of the link flanges of the central tube.

4. The adjustable table as claimed in claim 3, wherein the mounting bracket has two bridges mounted oppositely on the mounting bracket; and two first sliding elements mounted respectively on the bridges;

each outside tabletop component further has two second sliding elements mounted on the bottom surface and slidably engaged respectively with the first sliding elements of the base.

5. The adjustable table as claimed in claim 4, wherein the first sliding elements are gears rotatably mounted respectively on the bridges; and the second sliding elements of each outside tabletop components are racks respectively geared engaged respectively to with the gears so that the outside tabletop components are capable of sliding symmetrically on the base.

6. The adjustable table as claimed in claim 5, wherein the central tube further has a fastening pin mounted through the central tube and the shaft to securely hold the central tube around the shaft.

* * * * *